US010093003B2

(12) United States Patent
Kim et al.

(10) Patent No.: US 10,093,003 B2
(45) Date of Patent: Oct. 9, 2018

(54) ADJUSTABLE UNIVERSAL PIPE FASTENING TOOL

(71) Applicants: WORLD TOOLS CO., LTD., Ulsan (KR); Ulsan College Industry Academy Cooperation Foundat, Ulsan (KR)

(72) Inventors: Jae Soo Kim, Yongin-si (KR); Si Hwan Park, Suwon-si (KR)

(73) Assignees: WORLD TOOLS CO., LTD., Ulsan (KR); ULSAN COLLEGE INDUSTRY ACADEMY COOPERATION FOUNDATION, Ulsan (KR)

( * ) Notice: Subject to any disclaimer, the term of this patent is extended or adjusted under 35 U.S.C. 154(b) by 31 days.

(21) Appl. No.: 15/301,144

(22) PCT Filed: Apr. 8, 2015

(86) PCT No.: PCT/KR2015/003546
§ 371 (c)(1),
(2) Date: Sep. 30, 2016

(87) PCT Pub. No.: WO2015/156610
PCT Pub. Date: Oct. 15, 2015

(65) Prior Publication Data

US 2017/0021477 A1 Jan. 26, 2017

(30) Foreign Application Priority Data

Apr. 8, 2014 (KR) ..... 10-2014-0041989

(51) Int. Cl.
*B25B 13/50* (2006.01)
*B25B 13/16* (2006.01)

(52) U.S. Cl.
CPC ..... *B25B 13/505* (2013.01); *B25B 13/16* (2013.01)

(58) Field of Classification Search
CPC ..... B25B 13/16; B25B 13/12; B25B 13/14; B25B 13/505; B25F 1/04; B25F 1/003
See application file for complete search history.

(56) References Cited

U.S. PATENT DOCUMENTS 2,649,824 A * 8/1953 Maxwell ..... B25B 13/505 81/177.85
5,251,518 A * 10/1993 Woo ..... B25B 13/28 81/58

(Continued)

FOREIGN PATENT DOCUMENTS

KR 20-1993-0006508 Y1 9/1993
KR 10-2009-0113924 A 11/2009

(Continued)

*Primary Examiner* — Christopher M Koehler
*Assistant Examiner* — Henry Hong
(74) *Attorney, Agent, or Firm* — John K. Park; Park Law Firm

(57) ABSTRACT

An adjustable universal pipe fastening tool is configured such that mechanical elements, particularly fastening members such as bolts and nuts and pipes, can be easily fastened and unfastened using a single tool, thereby ensuring a convenient use. Particularly, an adjustable universal pipe fastening tool having a spanner portion is provided, which is configured to rotate, and a wrench portion, which is configured to be able to slide. The adjustable universal pipe fastening tool according to the present invention comprises: a body portion, which has a sliding hole formed on a surface thereof; a spanner portion formed on one side of the body portion so as to manage fastening and unfastening of mechanical elements; and a wrench portion formed on the other side of the body portion so as to manage fastening and (Continued)

unfastening of mechanical elements while sliding inside the sliding hole of the body portion.

6 Claims, 4 Drawing Sheets

(56) References Cited

U.S. PATENT DOCUMENTS

| | | | | | |
|---|---|---|---|---|---|
| 5,862,722 | A * | 1/1999 | Cislo | B25B 13/12 | 81/164 |
| 5,970,553 | A * | 10/1999 | Lin | B25B 13/16 | 7/139 |
| 6,029,548 | A * | 2/2000 | Hsieh | B25B 13/16 | 81/166 |
| 2011/0192259 | A1 * | 8/2011 | Stauss | B25B 13/04 | 81/170 |

FOREIGN PATENT DOCUMENTS

| | | | |
|---|---|---|---|
| KR | 10-0971033 | B1 | 7/2010 |
| KR | 20-2010-0012568 | U | 12/2010 |

* cited by examiner

【Fig. 1】
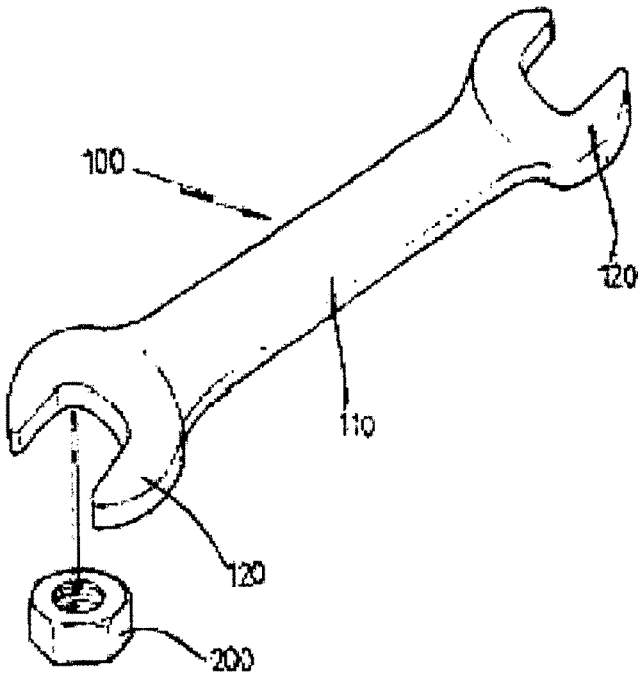
【Fig. 2】
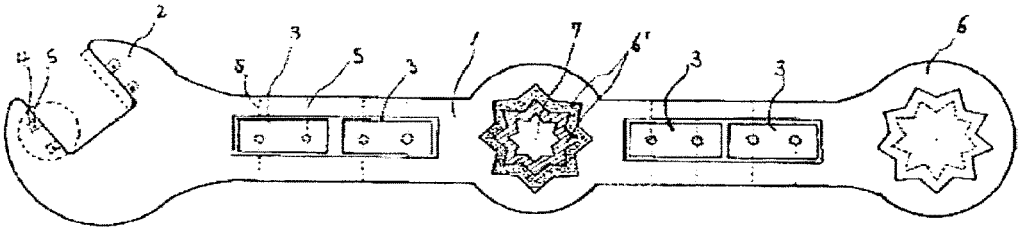

【Fig. 3】
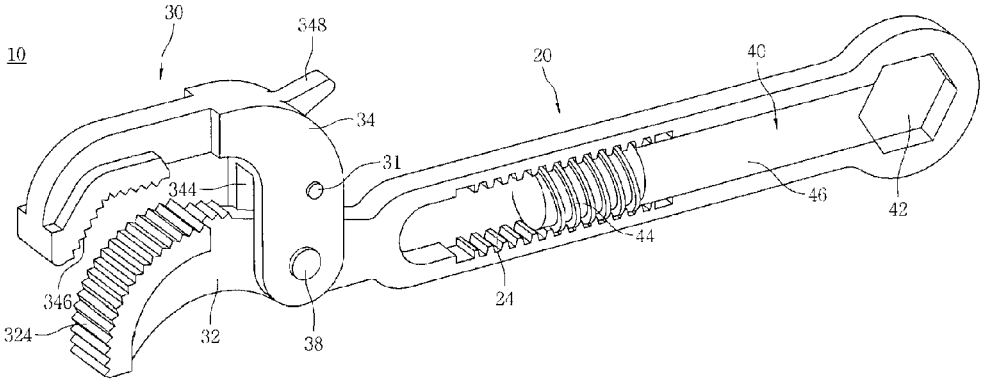
【Fig. 4】
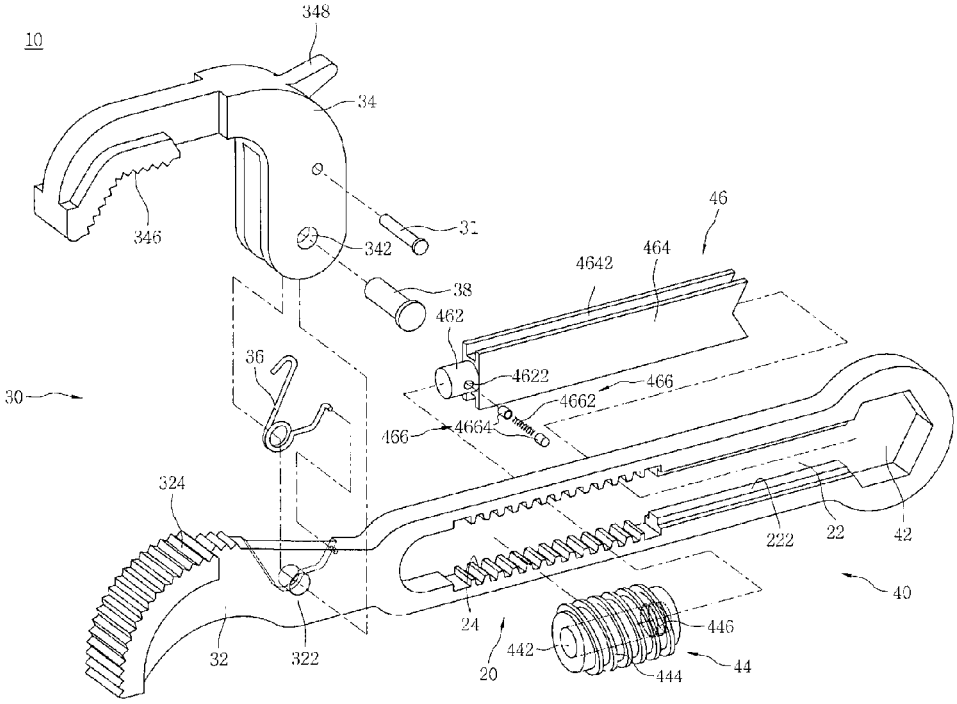

【Fig. 5】
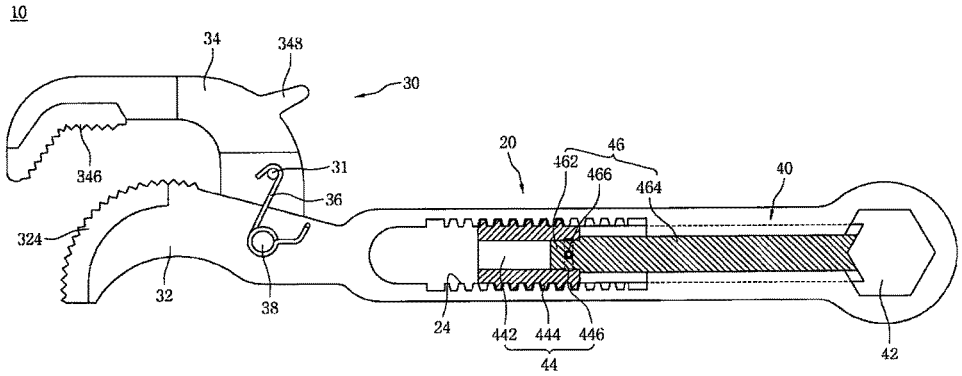
【Fig. 6】
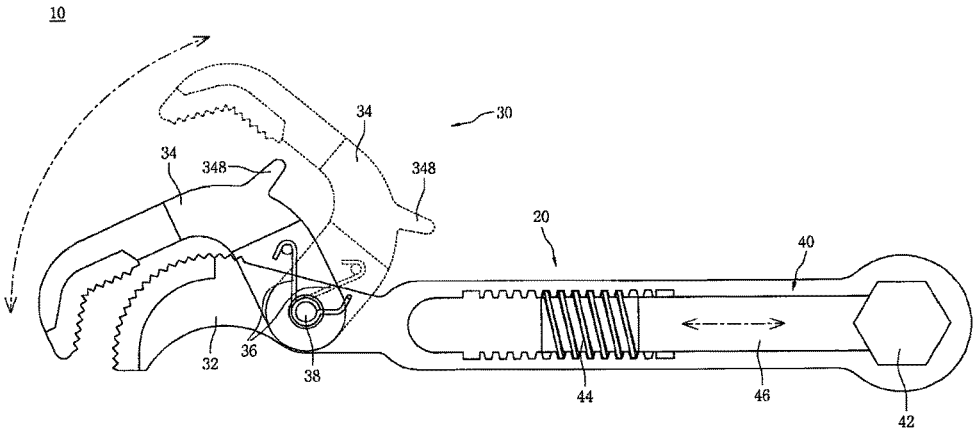

【Fig. 7】
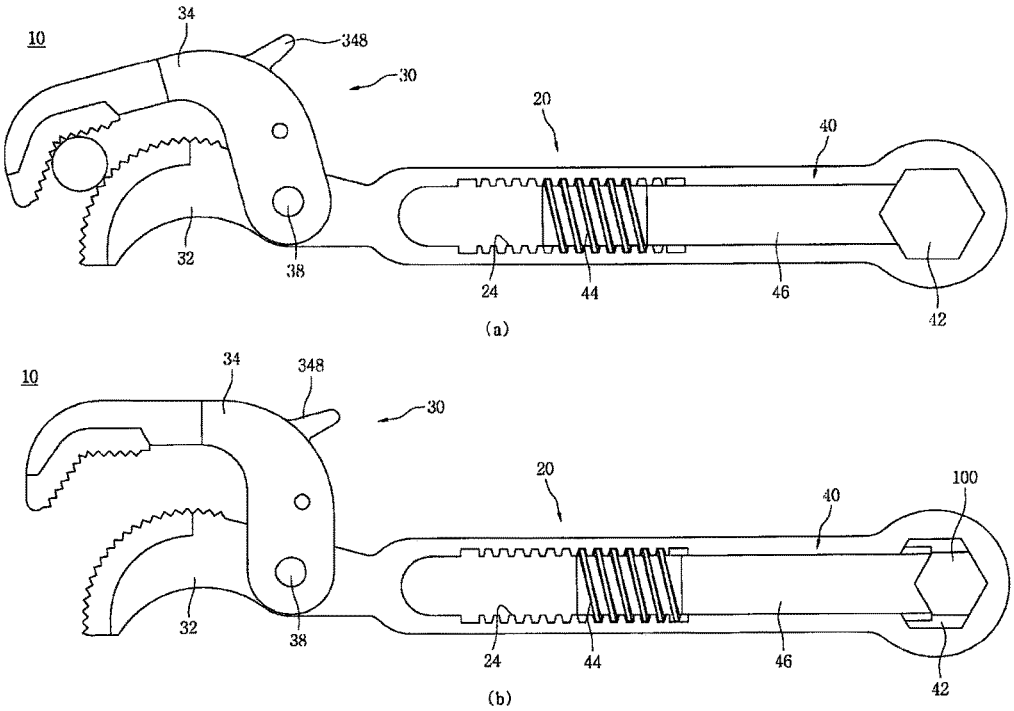

ADJUSTABLE UNIVERSAL PIPE FASTENING TOOL

TECHNICAL FIELD

The present invention relates to an adjustable universal pipe fastening tool, and more particularly to, such an adjustable universal pipe fastening tool configured such that mechanical elements having various sizes and shapes, i.e., fastening members such as bolts and nuts, and pipes, can be easily fastened and unfastened using a single tool, thereby ensuring convenience of use.

BACKGROUND ART

In general, fastening members having various sizes and shapes for securely fixing or connecting parts are used in mechanical devices or various structures. Such fastening members are fastened and unfastened by means of a spanner or a wrench.

As shown in FIG. 1, the spanner or the wrench 100 includes a handle 110 having a predetermined length, and a pair of opposed clamping parts 120 formed at both ends thereof to clamp and unclamp a fastening member 200 such as a bolt or a nut.

The wrench 100 includes a knurled handle 110 that has a predetermined length to allow an operator to grasp the handle 110 and is provided with multiple protrusions and multiple recesses alternately arranged with each other in the transverse and longitudinal directions. In addition, the wrench 100 includes a pair of opposed clamping parts 120 formed at both ends of the handle 110 to correspond to the fastening member 200 of a square or hexagonal shape. In other words, each of the clamping parts 120 is formed in a square or hexagonal shape so that the nut or the bolt head is fitted into a jaw opening of the clamping part 120, and is manufactured into various sizes so that the clamping part 120 is used to fasten and unfasten the fastening members 200 of various sizes.

The above-mentioned wrench 100 is configured such that an operator places the clamping part 120 on the bolt head or the nut of a square or hexagonal shape and rotates the clamping part 120 in one direction or in the reverse direction to achieve the fastening or unfastening operation.

However, the wrench 100 entails a problem in that since it is used only for a single kind of the fastening member 200 having a given size, the operator suffers from an inconvenience of having to prepare the wrenches 100 having various sizes to fit the fastening members 200 of various sizes.

In addition, the wrench 100 can be applied only to the fastening member 200 such as a bolt and a nut, and a separate tool is necessary to fasten and unfasten a mechanical element such as a pipe.

In an attempt to solve the above problems, patent document 1 has proposed an adjustable universal pipe fastening tool configured to fasten and unfasten mechanical elements having various sizes and shapes. As shown in FIG. 2, in a polygonal dimension conversion wrench proposed in the patent document 1 as an example of the adjustable universal pipe fastening tool, concaved recesses 4 are formed in a clamping part 2 of a main body 1, fixing pins 5 capable of attaching a folded plate 3 are elastically mounted in the concaved recesses 4, and leg portions 3' of the folded plates 3 are fitted into the concaved recesses 4 to cause depressed portions 3" of the leg portions 3' to be fixed by the fixing pins 5 so that the dimension of the clamping part 2 is changed by the thickness of the folded part 3, and thereby implementing a general purpose wrench enabling a free change in the dimension through the use of the folded plates of various thicknesses as well as a polygonal dimension conversion wrench enabling the creation of various dimensions through the use of polygonal dimension converting folded plates 6' having different inner diameters.

However, the above-mentioned wrench encounter problems in that it must be provided with a plurality of folded plates, and the use of the wrench may be restricted due to a loss of the folded plates.

PRIOR ART LITERATURE

Patent Documents

Document 1: Korean Utility Model Laid-Open Publication No. 20-1999-0034648 entitled "Dimension Conversion Wrench"

DISCLOSURE OF INVENTION

Technical Problem

Accordingly, the present invention has been made to solve the above-mentioned problems occurring in the prior art, and it is an object of the present invention to provide a novel adjustable universal pipe fastening tool configured such that mechanical elements having various sizes and shapes, i.e., fastening members such as bolts and nuts, and pipes, can be easily fastened and unfastened using a single tool, thereby ensuring convenience of use.

In particular, it is an object of the present invention is to provide an adjustable universal pipe fastening tool in which a spanner unit is constructed in a rotatable manner and a wrench unit is constructed in a slidable manner so that mechanical elements can be fastened and unfastened irrespective of the size and shape thereof.

Technical Solution

To achieve the above objects, the present invention provides an adjustable universal pipe fastening tool comprising: a body formed in a bar shape to allow a user to grasp it and having a sliding slot formed therein; a spanner unit formed at one end of the body and configured to manage a fastening and unfastening operation of a mechanical element; and a wrench unit formed at the other end of the body and configured to manage the fastening and unfastening operation of the mechanical element while slidably moving along the sliding slot.

In the adjustable universal pipe fastening tool of the present invention, the spanner unit may include: a fixing member formed so as to extend outwardly from one side of the body and including a hinge hole formed therein; a rotating member formed in a 'L' shape, the rotating member including a hinge hole formed at one side thereof so as to allow a hinge pin to be inserted thereinto so that the rotating member is hingeably coupled to the fixing member by means of the hinge pin, an incised part partially formed in the one side thereof, and a retaining pin mounted at a close distal end of the incised part so as to fix the mechanical element and manage the fastening and unfastening operation of the mechanical element; and an elastic member fixedly coupled at one side thereof to the hinge pin to generate an elastic force and coupled at the other end thereof to the retaining pin of the rotating member so as to allow the mechanical element to be fixed between the fixing member and the rotating member.

In the adjustable universal pipe fastening tool of the present invention, the fixing member of the spanner unit may include a plurality of projections formed on the top surface thereof, the rotating member comprises a plurality of projections formed on the underside of the other side thereof so that the mechanical element is positioned between the projections of the fixing member and the projections of the rotating member so as to manage the fastening and unfastening operation of the mechanical element.

In the adjustable universal pipe fastening tool of the present invention, the fixing member 32 of the spanner unit 30 may include a plurality of projections 324 formed on the top surface thereof, and the rotating member 34 may include a plurality of projections 346 formed on the underside of the other side thereof so that the mechanical element is positioned between the projections of the fixing member and the projections of the rotating member so as to manage the fastening and unfastening operation of the mechanical element.

In the adjustable universal pipe fastening tool of the present invention, the body may include a screw part formed at one side of the sliding slot thereof, and the wrench unit may include: a fixing opening formed at the other side of the sliding slot of the body so as to fluidically communicate with the sliding slot to allow the mechanical element to be positioned in the fixing opening; a worm roller gear including an insertion hole penetratingly formed therein and a screw part formed on the outer circumferential surface thereof so as to correspond to the screw part formed on the sliding slot of the body; and a sliding bar insertingly fixed to the insertion hole of the worm roller gear so as to be slidably moved along the sliding slot of the body.

In the adjustable universal pipe fastening tool of the present invention, the fixing opening of the wrench unit may include an inner circumferential surface formed in a polygonal shape, and a distal end of the sliding bar may be formed in a V-shape to prevent the mechanical element positioned in the fixing opening from escaping from the fixing opening.

In the adjustable universal pipe fastening tool of the present invention, the wrench unit may further include a spring positioned between the screw part and the sliding bar so as to allow the sliding bar and the mechanical element to be in close contact with each other.

Advantageous Effects

The adjustable universal pipe fastening tool according to the present invention has the following advantageous effects.

Mechanical elements having various sizes and shapes, i.e., fastening members such as bolts and nuts, and pipes, can be easily fastened and unfastened using a single tool, thereby ensuring convenience of use.

In particular, the spanner unit is constructed in a rotatable manner and the wrench unit is constructed in a slidable manner so that the mechanical elements can be fastened and unfastened irrespective of the size and shape thereof.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIGS. 1 and 2 are schematic views showing a wrench according to the prior art;

FIG. 3 is an assembled perspective view illustrating an adjustable universal pipe fastening tool according to a preferred embodiment of the present invention;

FIG. 4 is an exploded perspective view illustrating an adjustable universal pipe fastening tool according to a preferred embodiment of the present invention;

FIG. 5 is a cross-sectional view illustrating an adjustable universal pipe fastening tool according to a preferred embodiment of the present invention;

FIG. 6 is a view illustrating an operating state of an adjustable universal pipe fastening tool according to a preferred embodiment of the present invention; and FIG. 7 is a view illustrating a use state of an adjustable universal pipe fastening tool according to a preferred embodiment of the present invention.

*Explanation on reference numerals of main elements in the drawings*

| | |
|---|---|
| 10: adjustable universal pipe fastening tool | |
| 20: body | 22: sliding slot |
| 24: screw part | 30: spanner unit |
| 32: fixing member | 34: rotating member |
| 36: elastic member | 40: wrench unit |
| 42: fixing opening | 44: worm roller gear |
| 46: sliding bar | |

BEST MODE FOR CARRYING OUT THE INVENTION

The preferred embodiment of the present invention will be described hereinafter in detail with reference to FIGS. 3 to 7. In FIGS. 3 to 7, elements of performing the same function are denoted by the same reference numerals. In the meantime, in the detailed description and the accompanying drawings, illustration and explanation on the detailed technical construction and operation of elements, which have no direct connection with the technical features of the present invention, will be omitted, and only the technical constructions directly related with the present invention will be briefly illustrated and explained.

Referring to FIGS. 3 to 7, an adjustable universal pipe fastening tool 10 according to a preferred embodiment of the present invention includes a body 20, a spanner unit 30, and a wrench unit 40.

The body 20 is formed in a bar shape to allow a user to grasp it and has a sliding slot 22 formed therein. In this case, a screw part 24 is formed at one side of the sliding slot 22 so that a worn roller gear 44 of the wrench unit 40 which will be described can be slidably meshed with the screw part 24.

In the meantime, the body 20 includes a protrusion 222 formed upwardly on a bottom surface of the sliding slot in the longitudinal direction thereof to prevent a sliding bar 46 from escaping from the sliding slot 22 while slidably moving along the sliding slot 22.

The spanner unit 30 serves to manage a fastening and unfastening operation of a mechanical element 100 such as a pipe, a bolt, a nut, or the like. The spanner unit 30 includes a fixing member 32 extending outwardly from one side of the body 20, a rotating member 34 hingeably coupled to the fixing member 32, and an elastic member 36 configured to elastically support the rotating member 34 to fix the mechanical element 100 by an elastic force of the elastic member 36.

The fixing member 32 is formed in an upwardly convex hemispherical shape so as to extend outwardly from one side of the body 20. The fixing member 32 has a hinge hole 322 formed therein and a plurality of projections 324 formed on the top surface thereof. In this case, each of the projections 324 is formed in a saw-toothed shape.

The rotating member 34 is formed in a 'L' shape. The rotating member 34 has a hinge hole 342 formed at one side thereof so as to allow a hinge pin 38 to be inserted thereinto so that the rotating member 34 is hingeably coupled to the fixing member 32 by means of the hinge pin 38. The rotating member 34 includes an incised part 344 partially formed in the one side thereof so as to extend inwardly upwardly from a portion hingeably coupled to the fixing member 32. In other words, the fixing member 32 is positioned between both sidewalls of the one side of the rotating member 34, which defines the incised part 344, so that the rotating member 34 is hingeably coupled to the fixing member 32 by means of the hinge pin 38.

In addition, the rotating member 34 includes a retaining pin 31 mounted at a close distal end of the incised part 344 so that an elastic member 36, which will be described later, to be fixed by the retaining pin 31. The rotating member 34 includes a plurality of projections 346 formed on the underside of the other side thereof and a pulling element 348 formed on an upper portion thereof to allow a user to pull the pulling element 348 toward the one side thereof to cause the rotating member 34 to rotate about the hinge pin 38. In this case, each of the projections 346 is formed in a saw-toothed shape.

The elastic member 36 is fixedly coupled at one side thereof to the hinge pin 38 inserted into the hinge hole 322 of the fixing member 32 to generate an elastic force and is coupled at the other end thereof to the retaining pin 31 of the rotating member 34 so as to allow the rotating member 34 to rotate relative to the fixing member to return to a predetermined position. As used herein, the phrase "predetermined position" refers to a position where the projections 324 of the fixing member 32 is nearly in contact with the projections 346 of the rotating member 34. The mechanical element 100 is positioned between the projections 324 of the fixing member 32 and the projections 346 of the rotating member 34 so that the mechanical element 100 can be held in position by the elastic force of the elastic member 36.

The elastic member 36 is preferably formed as a hook spring.

As described above, in the adjustable universal pipe fastening tool according to a preferred embodiment of the present invention, the spanner unit is formed at one side of the body so that the mechanical element 100 such as a pipe, a bolt, a nut or the like can be easily fastened and unfastened. In particular, the projections are formed on the fixing member and the rotating member of the spanner unit so that the mechanical element can be stably held in position by the projections during the fastening and unfastening operation of the mechanical element, thereby increasing the efficiency of an operation.

The wrench unit 40 includes a fixing opening 42 formed at the other side of the sliding slot 22 of the body 20 so as to fluidically communicate with the sliding slot 22 to allow the mechanical element 100 such as a bolt or a nut to be positioned in the fixing opening 42, a worm roller gear 44 meshed with the screw part 24 of the body 20 to correspond to the screw part 24, and a sliding bar 46 coupled to the worm roller gear 44 so as to slidably move along the sliding slot 22 of the body 20 along with the movement of the worm roller gear 44. The fixing opening 42 has an inner circumferential surface formed in a polygonal shape, and a distal end of the sliding bar 46 is formed in a V-shape to prevent the mechanical element 100 positioned in the fixing opening 42 from escaping from the fixing opening 42.

The worm roller gear 44 has an insertion hole 442 penetratingly formed therein, a screw part 444 formed on the outer circumferential surface thereof so as to correspond to the screw part 24 formed on the sliding slot 22 of the body 20, and a groove 446 formed on the inner circumferential surface of the insertion hole 442.

The sliding bar 46 is slidably inserted into the sliding slot 22 of the body 20 and is formed in a shape corresponding to that of the sliding slot 22. The sliding bar 46 includes an escape-preventive groove 4642 formed thereon so as to be fitted around the protrusion 222 formed on the sliding slot 22. In addition, the sliding bar 46 includes an insertion lug 462 having a through-hole 4622 formed at a position corresponding to the groove 446 formed on the insertion hole 442 of the worm roller gear 44 so as to inserted into the insertion hole 442 of the worm roller gear 44, a slider 464 formed integrally with the insertion lug 462 and disposed at the other side of the sliding slot 22 of the body 20, and an elastic element 466 insertingly disposed in the through-hole 4622 of the insertion lug 462 so as to be fitted into the groove 446 formed on the insertion hole 462 of the worm roller gear 44.

The elastic element 466 includes a spring 4662 and a spring guide 4664 fittingly inserted into the groove 446 formed on the insertion hole 442 of the worm roller gear 44 and configured to prevent the escape of the spring 4662.

When the sliding bar 46 is inserted into the insertion hole 442 of the worm roller gear 44, it the elastic element 466 positioned in the through-hole 4622 of the insertion lug 462 is positioned in the groove 446 of the worm roller gear 44 so that the worm roller gear 44 can rotate upon the slidable movement of the sliding bar 46.

As such, the wrench unit is formed with the fixing opening having the inner circumferential surface of a polygonal shape, and the sliding bar whose distal end is formed in a V-shape is slidably disposed in the sliding slot of the body so that a mechanical element such as a bolt or a nut is stably fixed by the fixing opening and the sliding bar so as to easily fasten and unfasten the mechanical element.

As described above, the adjustable universal pipe fastening tool of the present invention has an effect in that mechanical elements having various sizes and shapes, i.e., fastening members such as bolts and nuts, and pipes, can be easily fastened and unfastened using a single tool, thereby promoting convenience of use.

In particular, the adjustable universal pipe fastening tool of the present invention has another effect in that the spanner unit is constructed in a rotatable manner and the wrench unit is constructed in a slidable manner so that mechanical elements can be fastened and unfastened irrespective of the size and shape thereof.

FIG. 6 is a view illustrating an operating state of an adjustable universal pipe fastening tool according to a preferred embodiment of the present invention, and FIG. 7 is a view illustrating a use state of an adjustable universal pipe fastening tool according to a preferred embodiment of the present invention.

Referring to FIGS. 6 and 7, in the adjustable universal pipe fastening tool 10 according to a preferred embodiment of the present invention, in the case where it is desired to fasten and unfasten the mechanical element 100 such as a bolt, a nut, a pipe or the like, when a user pulls the pulling element 348 formed on the rotating member 34 of the spanner unit 30, the rotating member 34 rotates about the hinge pin 38 so as to allow the mechanical element 100 to be positioned between the fixing member 32 and the rotating member 34. Subsequently, when the user releases the pulling state of the pulling element 348, the rotating member 34 is brought into close contact with the mechanical element 100 by the elastic force of the elastic member 36 to cause the mechanical element 100 to be held in position so that the user can fasten and unfasten the mechanical element 100 while turning the body 20 to the left or right.

In addition, when the user places the mechanical element 100 such as a bolt or a nut in the fixing opening 42 of the wrench unit 40 and then rotates the worm roller gear 44, the sliding bar 46 comes into close contact with the mechanical element 100 while slidably moving along the sliding slot 22 of the body 20. In this case, the mechanical element 100 is positioned at the fixing opening and the V-shaped distal end of the sliding bar 46 so that the user can fasten and unfasten the mechanical element 100 while turning the body 20 to the left or right.

While the adjustable universal pipe fastening tool according to a preferred embodiment of the present invention has been described in connection with the exemplary embodiments illustrated in the drawings, they are merely illustrative embodiments, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should be defined by the technical spirit of the appended claims.

The invention claimed is:

1. An adjustable universal pipe fastening tool comprising:

a body formed in a bar shape to allow a user to grasp the tool and having a sliding slot formed therein;

a spanner unit formed at one end of the body and configured to manage a fastening and unfastening operation of a mechanical element; and a wrench unit formed at an other end of the body and configured to manage the fastening and unfastening operation of the mechanical element while slidably moving along the sliding slot, wherein the body comprises a screw part formed at one side of the sliding slot thereof, and wherein the wrench unit comprises:

a fixing opening formed at an other side of the sliding slot of the body so as to fluidically communicate with the sliding slot to allow the mechanical element to be positioned in the fixing opening;

a worm roller gear including an insertion hole penetratingly formed therein and a screw part formed on an outer circumferential surface thereof so as to correspond to the screw part formed on the sliding slot of the body; and a sliding bar insertingly fixed to the insertion hole of the worm roller gear so as to be slidably moved along the sliding slot of the body, wherein the worm roller near comprises a groove formed on the inner circumferential surface of the insertion hole, and wherein the sliding bar comprises:

an insertion lug having a through-hole formed at a position corresponding to the groove formed on the insertion hole of the worm roller gear so as to be inserted into the insertion hole of the worm roller gear;

a slider formed integrally with the insertion lug and disposed at the other side of the sliding slot of the body; and an elastic element insertingly disposed in the through-hole of the insertion lug so as to be fitted into the groove formed on the insertion hole of the worm roller gear.

2. The adjustable universal pipe fastening tool according to claim 1, wherein the spanner unit comprises:

a fixing member formed so as to extend outwardly from one side of the body and including a hinge hole formed therein;

a rotating member formed in a 'L' shape, the rotating member including a hinge hole formed at one side thereof so as to allow a hinge pin to be inserted thereinto so that the rotating member is hingeably coupled to the fixing member by means for the hinge pin, an incised part partially formed in the one side thereof, and a retaining pin mounted at a close distal end of the incised part so as to fix the mechanical element and manage the fastening and unfastening operation of the mechanical element; and an elastic member fixedly coupled at one side thereof to the hinge pin to generate an elastic force and coupled at an other end thereof to the retaining pin of the rotating member so as to allow the mechanical element to be fixed between the fixing member and the rotating member.

3. The adjustable universal pipe fastening tool according to claim 2, wherein the fixing member of the spanner unit comprises a plurality of projections formed on a top surface thereof, and the rotating member comprises a plurality of projections formed on an underside of an other side thereof so that the mechanical element is positioned between the projections of the fixing member and the projections of the rotating member so as to manage the fastening and unfastening operation of the mechanical element.

4. The adjustable universal pipe fastening tool according to claim 1, wherein the elastic element comprises a spring and a spring guide fittingly inserted into the groove formed on the insertion hole of the worm roller gear and configured to prevent the escape of the spring.

5. The adjustable universal pipe fastening tool according to claim 1, wherein the fixing opening of the wrench unit comprises an inner circumferential surface formed in a polygonal shape, and wherein a distal end of the sliding bar is formed in a V-shape to prevent the mechanical element positioned in the fixing opening from escaping from the fixing opening.

6. The adjustable universal pipe fastening tool according to claim 1, wherein the fixing opening of the wrench unit comprises an inner circumferential surface formed in a polygonal shape, and wherein a distal end of the sliding bar is formed in a V-shape to prevent the mechanical element positioned in the fixing opening from escaping from the fixing opening.

* * * * *